US010005970B2

(12) United States Patent
Cho et al.

(10) Patent No.: US 10,005,970 B2
(45) Date of Patent: Jun. 26, 2018

(54) METHOD AND APPARATUS FOR TREATING HEAVY HYDROCARBON OIL USING LIQUID PHASE OF HYDROCARBON OIL

(71) Applicant: KOREA INSTITUTE OF ENERGY RESEARCH, Daejeon (KR)

(72) Inventors: Dong Woo Cho, Daejeon (KR); Ko Yeon Choo, Daejeon (KR); Jong Ho Park, Daejeon (KR); Kweon Ill Kim, Daejeon (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 23 days.

(21) Appl. No.: 15/296,199

(22) Filed: Oct. 18, 2016

(65) Prior Publication Data

US 2017/0107432 A1 Apr. 20, 2017

(30) Foreign Application Priority Data

Oct. 19, 2015 (KR) ..... 10-2015-0145345

(51) Int. Cl.

| | |
|---|---|
| ***C10G 33/00*** | (2006.01) |
| ***C10G 33/04*** | (2006.01) |
| ***C10G 55/04*** | (2006.01) |
| ***C10G 67/02*** | (2006.01) |
| ***C10G 53/04*** | (2006.01) |
| ***C10G 55/06*** | (2006.01) |

(52) U.S. Cl.

CPC ..... *C10G 33/00* (2013.01); *C10G 33/04* (2013.01); *C10G 53/04* (2013.01); *C10G 55/04* (2013.01); *C10G 55/06* (2013.01); *C10G 67/02* (2013.01); *C10G 2300/802* (2013.01)

(58) Field of Classification Search

CPC ..... C10G 33/00; C10G 55/06; C10G 53/04; C10G 55/04; C10G 33/04; C10G 67/02; C10G 2300/802

See application file for complete search history.

(56) References Cited

U.S. PATENT DOCUMENTS

| | | | | |
|---|---|---|---|---|
| 4,455,221 | A | 6/1984 | Calderon | |
| 5,948,242 | A | 9/1999 | Ohsol et al. | |
| 7,276,151 | B1 | 10/2007 | Okada et al. | |
| 2002/0079248 | A1* | 6/2002 | Kresnyak | C10G 33/00 208/187 |
| 2004/0007500 | A1* | 1/2004 | Kresnyak | C10G 33/00 208/187 |

FOREIGN PATENT DOCUMENTS

JP 06017057 A 1/1994

OTHER PUBLICATIONS

KIPO Notice of Allowance for Korean Application No. 10-2015-0145345 dated Feb. 20, 2017.

* cited by examiner

*Primary Examiner* — Randy Boyer
*Assistant Examiner* — Juan C Valencia
(74) *Attorney, Agent, or Firm* — LRK Patent Law Firm

(57) ABSTRACT

A technique for treating heavy hydrocarbon oil in the oil production process or oil refining process. A method and apparatus for adding and mixing a liquid phase of hydrocarbon oil to a hydrocarbon oil feedstock containing heavy hydrocarbon oil in an oil production process or oil refining process including a hydrocarbon oil dehydration process, thereby processing the heavy hydrocarbon oil to be lighter and thus increasing the throughput of the heavy hydrocarbon oil.

12 Claims, 2 Drawing Sheets

METHOD AND APPARATUS FOR TREATING HEAVY HYDROCARBON OIL USING LIQUID PHASE OF HYDROCARBON OIL

CROSS-REFERENCE TO RELATED APPLICATION(S)

This application claims priority to Korean Patent Application No. 10-2015-0145345, filed Oct. 19, 2015, in the Korean Intellectual Property Office, the entire disclosure of which is incorporated herein by reference for all purposes.

BACKGROUND OF THE INVENTION

1. Field of the Invention

The present invention relates to a technique for treating heavy hydrocarbon oil in the oil production process or oil refining process. More particularly, the present invention relates to a method and apparatus for adding and mixing a liquid phase of hydrocarbon oil to a hydrocarbon oil feedstock containing heavy hydrocarbon oil in the oil production process or oil refining process including a hydrocarbon oil dehydration process, thereby processing the heavy hydrocarbon oil to be lighter and thus increasing the throughput of the heavy hydrocarbon oil.

2. Description of Related Art

The demand for fossil fuels such as petroleum or the like keeps increasing, but oil prices are rising all over the world with the gradual depletion of oil. Particularly, as the developing countries like China, India, etc. are experiencing incremental economic growth, demands for energy and hydrocarbon oil are ever growing. In terms of supply, however, the production capacity of oil with low specific gravity has stretched to the limit or is dwindling, and the oil produced from the newly developed oil wells ever turns out to be heavier.

Petroleum (hydrocarbon oil) is classified as light, middle, heavy, or extra heavy, according to its specific gravity. The index commonly used for the specific gravity of petroleum is API (American Petroleum Institute) gravity, which is established by the API.

API gravity is a proportion of the density of oil to the density of water (60° F.). A hydrocarbon oil with relatively high API gravity is light hydrocarbon oil, and a hydrocarbon oil with relatively low API gravity is heavy hydrocarbon oil. The hydrocarbon oil having a higher API gravity displays lower viscosity and contains a larger quantity of volatile substances, while the hydrocarbon oil having a lower API gravity shows higher viscosity and contains a lower quantity of volatile substances. Hydrocarbon oil with higher API gravity is more expensive to produce.

Generally speaking, the term "light hydrocarbon oil" has an implicit meaning that the hydrocarbon oil has an API gravity greater than 30°. In an effort to fight the intensifying competition in the fields of oil refinery due to increased refinery facilities and negative profit margins, many countries around the world have adopted a method of using a large quantity of light hydrocarbon oil to dilute heavy hydrocarbon oil (with an API gravity less than 30°) that is relatively inexpensive.

This method, however, results in the reduced API gravity of the hydrocarbon oil. By the 1990's, oil production or refinery facilities had the ability to process light hydrocarbon oil having an API gravity of 35 to 40° only. Despite the recent advances in technology that allow the processing of hydrocarbon oil having an API gravity of 20 to 25°, most of the oil production or refinery facilities are designed or operated based on the hydrocarbon oil having an API gravity of 30, ending up having a limitation that the maximum proportion of heavy hydrocarbon oil blended with light hydrocarbon oil in an effort to secure the oil refinery profit is no more than 10 to 20%.

The reason of this is the increased stability of water-in-oil (W/O) emulsion produced in the hydrocarbon oil with the lower API gravity, that is, the heavier hydrocarbon oil, raising the risk of efficiency degradation, voltage loss, operational discontinuity, and so forth during the hydrocarbon oil dehydration process in the oil production or refinery facilities.

The hydrocarbon oil dehydration process can be performed in equipment like separator, coalescers, desalters, etc. For removal of water from hydrocarbon oil, the oil production facilities use separator that separate production fluids into three phases of gas, oil and water, and the oil refinery facilities basically have desalters to separate salts and moisture from hydrocarbon oil.

Desalting in the desalters is a necessary process because the salts remaining in the hydrocarbon oil can be decomposed during the distillation process and allow the formation of hydrochloric acid to accelerate corrosion or deposits in the equipment such as distillation columns, reducing the efficiency of the processing function. As the desalting process uses water to dissolve salts and adopts the basic approach to remove salts and water at the same time, it is necessary to include the oil-water separation process to remove water.

The removal of water from hydrocarbon oil is of great importance in the oil production or refinery facilities. Yet, it is difficult to eliminate water from heavy hydrocarbon oil, which is, unlike light hydrocarbon oil, has no significant difference in density from water and displays high stability of oil-in-water (O/W) or water-in-oil (W/O) emulsion.

For this reason, the hydrocarbon oil processed to be "heavier" is hard to meet the water cut that is an important parameter to evaluate the hydrocarbon oil after the dehydration process, and its high water content causes many troubles in the process and even leads to a shutdown.

In other words, there is a demand for the technique to increase the throughput of the hydrocarbon oil containing heavy hydrocarbon oil in the oil production or refinery facilities using the dehydration process by raising the proportion of heavy hydrocarbon oil blended with the relatively expensive light hydrocarbon oil and preventing a reduction of the API gravity as well.

BRIEF SUMMARY OF THE INVENTION

For solving the above-described problems with the prior art, it is an object of the present invention to provide a method and apparatus for treating heavy hydrocarbon oil that involves processing hydrocarbon oil containing heavy hydrocarbon oil to be "lighter" using a liquid phase of hydrocarbon oil to increase the throughput of the hydrocarbon oil in the dehydration process of the oil production or refining process, thereby decreasing the content of the relatively expensive light hydrocarbon oil and increasing the content of the relatively inexpensive heavy hydrocarbon oil, only to curtail the production cost and enhance the oil refinery profit.

For solving the above-described problems, there is provided a method for increasing the throughput of heavy hydrocarbon oil in an oil production or refining process including a dehydration process. More specifically, the present invention provides a method for treating heavy hydrocarbon oil that comprises the steps of: (a) adding and mixing a liquid phase of hydrocarbon oil to a hydrocarbon oil feedstock containing heavy hydrocarbon oil to produce a feedstock processed to be lighter; (b) removing water from the feedstock processed to be lighter; and (c) separating the feedstock from the dehydration step (a) into gas, non-residual oil and residue.

In this regard, the dehydration step (b) may be performed by at least one process of separation, coalescence and desalting.

The method may be designed to further comprise an oil-upgrading step (d) of modifying the residue to produce a liquid phase of hydrocarbon oil, after the separation step (c), where the liquid phase of hydrocarbon oil produced in the oil-upgrading step is added to the hydrocarbon oil feedstock of the mixing step (a).

The oil-upgrading step (d) may be performed to modify the residue by at least one process of thermal cracking, hydrocracking, solvent extraction, and catalytic cracking.

Further, the oil-upgrading step (d) may be performed to modify the residue by solvent extraction and then an additional process of thermal cracking, catalytic cracking or hydrocracking. In this case, part of the liquid phase of hydrocarbon oil produced from the solvent extraction of the residue is added to the hydrocarbon oil feedstock of the mixing step (a), and the rest part of the liquid phase of hydrocarbon oil is processed by the additional process of thermal cracking, catalytic cracking or hydrocracking and then added to the hydrocarbon oil feedstock of the mixing step (a).

Alternatively, the oil-upgrading step (d) may be performed to modify the residue by thermal cracking or catalytic cracking and then an additional process of hydrocracking. In this case, part of the liquid phase of hydrocarbon oil produced from the thermal cracking or catalytic cracking is added to the hydrocarbon oil feedstock of the mixing step (a), and the rest part of the liquid phase of hydrocarbon oil is processed by the additional process of hydrocracking and then added to the hydrocarbon oil feedstock of the mixing step (a).

Preferably, the hydrocarbon oil feedstock has an API gravity of 10 to 30°, and the liquid phase of hydrocarbon oil has an API gravity of 15° or greater.

In accordance with another embodiment of the present invention, there is provided an apparatus for increasing the throughput of heavy hydrocarbon oil in an oil production or refinery facility including a dehydration process. More specifically, the present invention provides an apparatus for treating heavy hydrocarbon oil that comprises: a mixer 1 for adding and mixing a liquid phase of hydrocarbon oil to a hydrocarbon oil feedstock containing heavy hydrocarbon oil to produce a feedstock processed to be lighter; a dehydrator 2 for removing water from the feedstock processed to be lighter; a separator 3 for separating the feedstock from the dehydrator 2 into gas, non-residual oil and residue; and an oil-upgrading unit 4 for modifying the residue to produce a liquid phase of hydrocarbon oil, where the liquid phase of hydrocarbon oil produced from the oil-upgrading unit 4 is added into the mixer 1.

In the apparatus, the dehydrator 2 may comprise at least one of a separator, a coalescer and a desalter.

Further, the oil-upgrading unit 4 may comprise at least one of a thermal cracking unit, a hydrocracking unit, a solvent extraction unit, and a catalytic cracking unit.

Preferably, the hydrocarbon oil feedstock has an API gravity of 10 to 30°, and the liquid phase of hydrocarbon oil has an API gravity of 15° or greater.

DETAILED DESCRIPTION OF THE INVENTION

Figure 1:
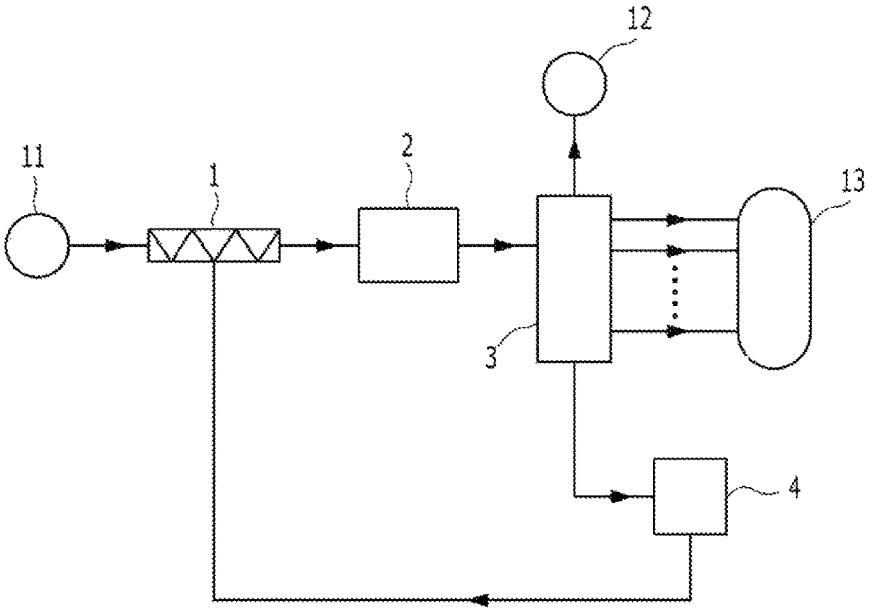
FIG. 1 is a schematic diagram showing the process of treating heavy hydrocarbon oil using a liquid phase of hydrocarbon oil according to one embodiment of the present invention.

Hereinafter, preferred embodiments of the present invention will be described in further detail with reference to the accompanying drawings. It should be understood that terms or words used in the specification and claims are not specifically analyzed as general or dictionary meanings but have meanings coinciding with those of terms in the technological conception of the present invention.

Throughout the specification and claims, unless specified otherwise, the words "include" or "including" will be understood to imply the inclusion of a stated integer or groups of integers but not the exclusion of any other integer or group of integers.

Identification codes for the individual steps are used for convenience of understandings and not given to specify the order of the steps. Unless the order of the steps is specified definitely in the context, the individual steps may be performed in a different order. In other words, the individual steps may be performed in the same order as specified or substantially at the same time or in the reverse order.

Throughout the specification, the term "front-end" means any direction in which a gas or fluid moves into a specific component. Likewise, the term "rear-end" of a component means any direction in which a gas or fluid moves out of the component.

Reference should be made to the drawings, in which the same reference numerals are used throughout the different drawings to designate the same or similar components as possible. Further, in the following description of the present invention, a detailed description of known configurations and functions incorporated herein will be omitted when it may make the subject matter of the present invention rather unclear.

Moreover, the terms "first", "second", "A", "B", (a), (b), etc. may be used in the description of the elements in the embodiment of the present invention. These terms are only used to distinguish one element from another and not given to confine the substance, sequence, order, or the like of the element.

It will also be understood that when an element is referred to as being "connected", "associated" or "coupled" to another element, it can be directly connected or coupled to the other element, or intervening elements may be present between the elements.

FIG. 1 is a schematic diagram showing the process of treating heavy hydrocarbon oil using a liquid phase of hydrocarbon oil according to one embodiment of the present invention.

The present invention provides a method for increasing the throughput of heavy hydrocarbon oil in an oil production or refining process including a dehydration process. More specifically, the present invention provides a method for treating heavy hydrocarbon oil using a liquid phase of hydrocarbon oil that comprises: (a) adding and mixing a liquid phase of hydrocarbon oil to a hydrocarbon oil feedstock containing heavy hydrocarbon oil to produce a feedstock processed to be lighter; (b) removing water from the feedstock processed to be lighter; and (c) separating the feedstock from the dehydration step (a) into gas, non-residual oil and residue.

In addition, the method for treating heavy hydrocarbon oil according to the present invention may be performed with an apparatus for treating heavy hydrocarbon oil that comprises: a mixer 1 for adding and mixing a liquid phase of hydrocarbon oil to a hydrocarbon oil feedstock containing heavy hydrocarbon oil to produce a feedstock processed to be lighter; a dehydrator 2 for removing water from the feedstock processed to be lighter; a separator 3 for separating the feedstock from the dehydrator 2 into gas, non-residual oil and residue; and an oil-upgrading unit 4 for modifying the residue to produce a liquid phase of hydrocarbon oil.

The process for treating heavy hydrocarbon oil may be described specifically as follows. First of all, a "light" liquid phase of hydrocarbon oil is added to and blended with a hydrocarbon oil feedstock containing heavy hydrocarbon oil supplied from a hydrocarbon oil source 11 to make the heavy hydrocarbon oil "lighter".

The hydrocarbon oil source 11 may be an oil well in the oil production facility or a hydrocarbon oil feeder in the oil refinery facility.

In this regard, the hydrocarbon oil feedstock is a hydrocarbon oil mixture that needs to be dehydrated and comprises any one of heavy hydrocarbon oil, a mixture of heavy hydrocarbon oil and light hydrocarbon oil, and middle hydrocarbon oil, as a principal component. Preferably, the hydrocarbon oil feedstock is a hydrocarbon oil mixture having an API gravity of 10 to 30°. When the hydrocarbon oil feedstock has an API gravity less than 10°, it is difficult to increase the API gravity to an optimum level even with an addition of the liquid phase of hydrocarbon oil. When the hydrocarbon oil feedstock has an API gravity greater than 30°, it is unnecessary to perform a process of increasing the API gravity through an additional step of making the hydrocarbon oil "lighter".

Further, the liquid phase of hydrocarbon oil is a substance that can be produced in the after-mentioned oil-upgrading process. Preferably, the liquid phase of hydrocarbon oil has an API gravity of 15° or greater. When the liquid phase of hydrocarbon oil has an API gravity less than 15°, it has an insignificant effect to make the heavy hydrocarbon oil "lighter" and results in a limitation in increasing the throughput of the heavy hydrocarbon oil. The liquid phase of hydrocarbon having the higher API gravity oil makes the stronger effect to increase the throughput of the heavy hydrocarbon oil. Generally, the liquid phase of hydrocarbon oil as used herein may have an API gravity in the range of 15 to 40°.

The API gravity is defined by the following Equation 1, where $SG_{oil}$ is the specific gravity of oil as calculated by the following Equation 2.

$$API_{gravity} = \frac{141.5}{SG_{oil}} - 131.5 \quad \text{[Equation 1]}$$

$$SG_{oil} = \frac{\rho_{oil}}{\rho_{H2O}} \quad \text{[Equation 2]}$$

where $\rho_{oil}$ is the density of oil; and $\rho_{H2O}$ is the density of water (60° F.).

The mixing step may be performed in a separate mixer 1 for uniformly mixing the hydrocarbon oil feedstock and the liquid phase of hydrocarbon oil together. The mixer 1 may be any type of mixer, such as an agitator, a line mixer, etc., as selected for its use purpose.

Figure 2:
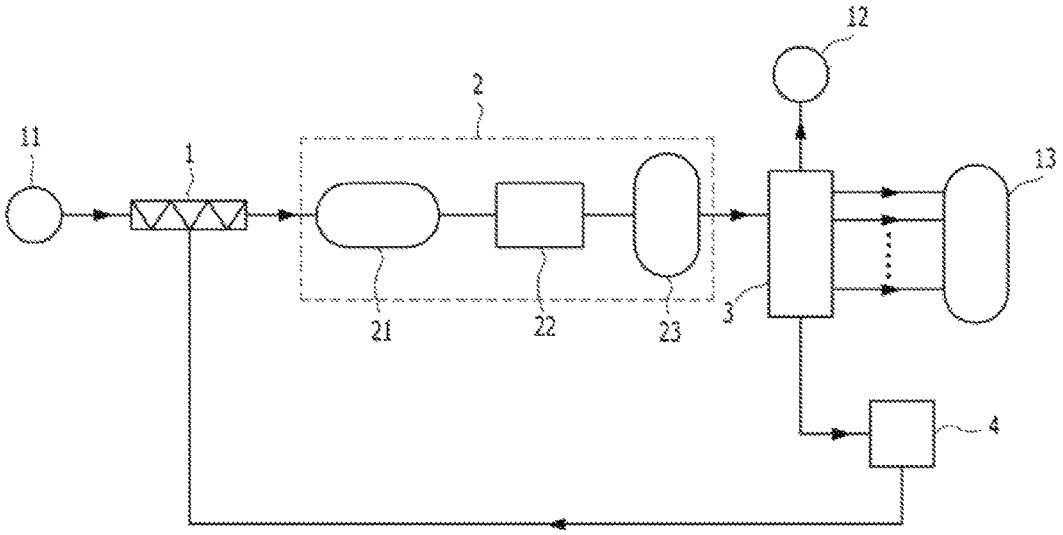
FIG. 2 is a schematic diagram showing the process of treating heavy hydrocarbon oil that includes a step of removing water from a hydrocarbon oil feedstock by oil-water separation, coalescence or desalting according to another embodiment of the present invention.

The hydrocarbon oil feedstock, which is processed to be "lighter" with the addition of the relatively "light" liquid phase of hydrocarbon oil and have a higher API gravity, goes to the dehydration step for removing water from the hydrocarbon oil feedstock. Preferably, as shown in FIG. 2, the hydrocarbon oil feedstock is removed of water through oil-water separation in an separator 21, coalescence in a coalesce 22, or desalting in a desalter 23.

Oil-water separation is the separation process of separating the hydrocarbon oil into three phases of gas, oil and water and removing a small quantity or trace of water from the hydrocarbon oil. This separation process removes oil-in-water (O/W) or water-in-oil (W/O) emulsion so that the hydrocarbon oil meets an optimum B&SW value. The general water cut in the oil production process is 0.5% or less.

The oil-water separation method using the separator 21 is preferably included, if not limited to, in the oil production process or oil refining process.

Coalescence is the process of removing water using the buoyancy of oil according to the density difference between oil and water. Preferably, the coalescence process may be performed, if not limited to, by an electric coalescer.

Desalting is the process of removing inorganic salts from the hydrocarbon oil prior to distillation. As the inorganic salts are entrained in water to form a suspension or an emulsion, it is necessary to perform dehydration in addition to desalting. In the specification, the term "desalting step/process" is construed as an inclusion of both desalting and dehydration.

Further, the desalting step performed in the desalter 23 can also eliminate metals, such as calcium (Ca), nickel (Ni), vanadium (V), etc.

The salt content of the hydrocarbon oil is typically about 10 to 3,000 ppm. The desalting method can be largely classified into two methods: electrical desalting and chemical desalting.

The electrical desalting process is primarily used as a desalting method and involves using a high-voltage current that is tens of thousands of volts to break water-associated emulsions in the hydrocarbon oil. In the electrical desalting process, about 5 to 10 vol. % of water is preheated and mixed with a hydrocarbon oil, and the mixture is added into a desalting tank, to which a high voltage is then applied under the conditions of 4 to 20 kg/cm$^2$ at 90° C. or above. As a result, water in the form of emulsion and salts settle down in the tank and get removed.

The chemical desalting process is a method of adding demulsifiers to the hydrocarbon oil to break the emulsion. In the chemical desalting process, demulsifiers and 5 to 10 vol. % of water are sequentially added into a desalting tank, preheated at 80° C. or above, mixed and then sent to a settling tank, where the water including salts settle down and get removed.

Such a desalting process using a desalter 23 is preferably included, if not limited to, in the oil refining process or oil production process.

The water removal from the hydrocarbon oil feedstock may be performed, as illustrated in FIG. 2, by at least one process of separation in the separator 21, coalescence in the coalescer 22 and desalting in the desalter 23. If the sequential order of the dehydration methods is not specifically limited, it is preferable to perform oil-water separation and then coalescence or desalting in the oil production process, and desalting right before or after coalescence in the oil refining process.

In the "heavier" hydrocarbon oil, the emulsion has the smaller size, higher stability and less difference in density from water. This makes it difficult to remove water from the hydrocarbon oil in the oil-water separation, coalescence or desalting process and causes problems such as voltage loss during the operation.

But, the mixing step involves adding a "light" liquid phase of hydrocarbon oil having an API gravity of 15° or greater to the hydrocarbon oil feedstock containing heavy hydrocarbon oil to produce a feedstock processed to be "lighter". It is thus possible to meet the API gravity required to the facilities in which the dehydration process is carried out. As a result, the throughput or capacity of the heavy hydrocarbon oil can be increased, only to achieve the ultimate goal, that is, enhancement of the hydrocarbon refinery profit.

The hydrocarbon oil feedstock from the dehydration step is sent to the separator 3 in which it is separated into gas, non-residual oil and residue. The gas may include $H_2S$, $C_1$-$C_3$ hydrocarbon, and part of $C_4$ hydrocarbon. The non-residual oil may include gasoline, diesel, kerosin, naphtha, etc. The other substances are residue, which are typically removed at the lowermost portion of the separator 3.

In this regard, the separator 3 may be a distillation unit, which includes an atmosphere distillation unit, a vacuum distillation unit, etc. Preferably, the vacuum distillation unit is connected to the rear end of the atmosphere distillation unit.

In the distillation unit, different types of petroleum oils contained in the desalted hydrocarbon feedstock are separated according to their boiling point. In addition to this, a separation method using membranes, adsorption, or the like may be adopted.

Out of the petroleum oils separated, the products such as gas, non-residual oil, etc. are sent to product supply sources 12 and 13 in which they are stored or undergo additional operations.

The residue that forms a huge molecule with a large number of carbons can be removed by using the fact that it exhibits high boiling point and high specific gravity. Characteristically, the production of the residue increases with an increase in the throughput of the heavy hydrocarbon oil. In order to make the use of the residue, an oil-upgrading step may be performed using an oil-upgrading unit 4.

Generally, the term "oil-upgrading" refers to the process of producing a "light" liquid phase of hydrocarbon oil from an extra heavy hydrocarbon oil such as the residue. The oil-upgrading process may include the process of thermal cracking, hydrocracking, solvent extraction, catalytic cracking, etc.

More specifically, the thermal cracking process may include carbon rejection, visbreaking, coking, delayed coking, etc. The hydrocracking process may include hydrotreating, hydrogen addition, etc. The solvent extraction process may include solvent deasphalting, etc.

The residue can be modified through at least one of the above-specified oil-upgrading methods. The liquid phase of hydrocarbon oil produced from the modification of the residue is added to the hydrocarbon oil feedstock in the mixing step.

As described above, the method and apparatus for treating heavy hydrocarbon oil according to the present invention makes heavy hydrocarbon oil "lighter" using a liquid phase of hydrocarbon oil, thereby increasing the throughput in the dehydration process and eventually enhancing the refinery profit, and produces the liquid phase of hydrocarbon oil by reusing the residue of which the production increases in the distillation step with an increase in the throughput of heavy hydrocarbon oil, thereby obtaining high efficiency.

Further, the method of treating heavy hydrocarbon oil according to the present invention has only to add the process of mixing a liquid phase of hydrocarbon oil with the hydrocarbon oil feedstock in the existing oil production or refinery facility, ending up reducing the cost required to add new facility.

Figure 3A:
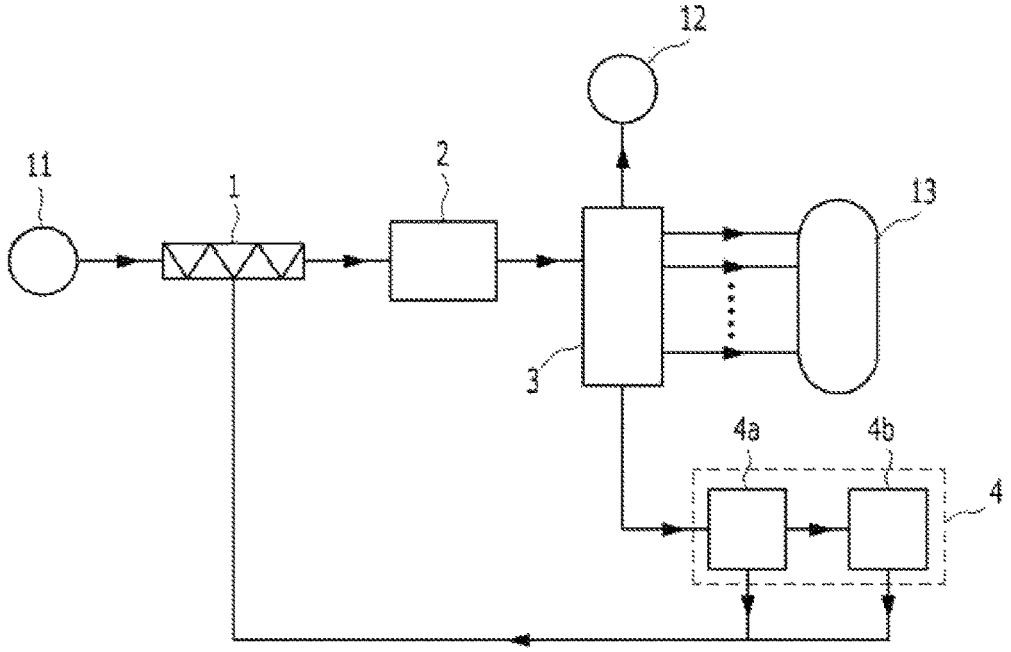
FIGS. 3A and 3B are schematic diagrams showing the process of treating heavy hydrocarbon oil that includes a step of modifying the residue through a specified oil-upgrading process according to further another embodiment of the present invention.
Figure 3B:
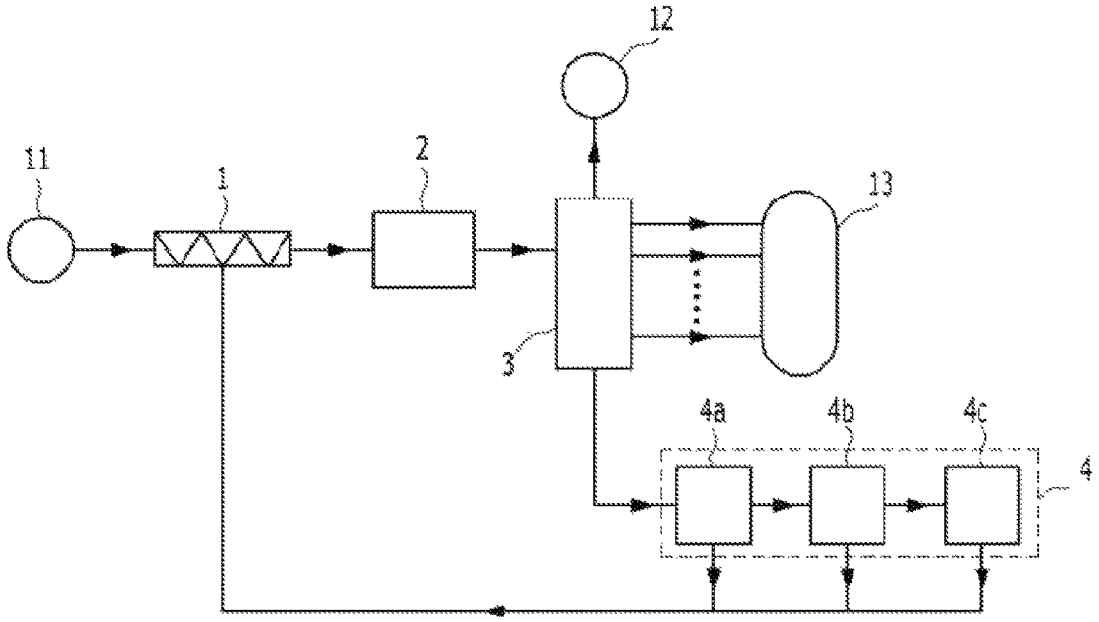

FIGS. 3A and 3B are schematic diagrams showing the process of treating heavy hydrocarbon oil that includes a step of modifying the residue through a specified oil-upgrading process according to further another embodiment of the present invention.

The method and apparatus for treating heavy hydrocarbon oil according to the present invention can modify the residue, as illustrated in FIGS. 3A and 3B, by at least two processes of thermal cracking, hydrocracking, solvent extraction, and catalytic cracking.

Further, as shown in FIG. 3A, the residue removed through the separation step in the separator 3 may undergo the solvent extraction process in a solvent extraction unit 4*a* and then the thermal cracking process in a thermal cracking unit 4*b*. Part of the liquid phase of hydrocarbon oil produced from the residue through the solvent extraction process is added to the hydrocarbon oil feedstock in the mixing step, and the rest part of the liquid phase of hydrocarbon oil is additionally subjected to the thermal cracking process and then added to the hydrocarbon oil feedstock.

In this regard, the thermal cracking unit 4*b* performing the thermal cracking process may be substituted by a catalytic cracking unit performing the catalytic cracking process or a hydrocracking unit performing the hydrocracking process.

The liquid phase of hydrocarbon oil produced from the residue through the thermal cracking or catalytic cracking process has paraffin and aromatic compounds as principal components and partly olefins and exhibits an API gravity of 28 to 35°, whereas the liquid phase of hydrocarbon oil produced from the residue through the solvent extraction solely contains has paraffin as a principal component and displays an API gravity of 13 to 20°.

In other words, the liquid phase of hydrocarbon oil produced from the solvent extraction solely is "heavy" with a relatively low API gravity but has paraffin as a principal component, so it is very suitable to make the heavy hydrocarbon oil "lighter".

Further, the hydrocracking process may result in formation of a liquid phase of hydrocarbon oil having a high API gravity of 40°.

Accordingly, it is possible to achieve the object of the present invention, that is, the increased throughput of heavy hydrocarbon oil by making the heavy hydrocarbon oil "lighter" in such a way to add part of the liquid phase of hydrocarbon oil produced from the solvent extraction process in the solvent extraction unit 4*a* and the rest part of the liquid phase of hydrocarbon oil being subjected to an additional process of thermal cracking, catalytic cracking or hydrocracking in the thermal cracking, catalytic cracking or hydrocracking unit 4*b* to the hydrocarbon oil feedstock. It is also possible to control the degree of making the heavy hydrocarbon oil "lighter" or the process-based economic feasibility by adjusting the added amounts of the liquid phase of hydrocarbon oil produced from the solvent extraction process solely and the liquid phase of hydrocarbon oil produced from the solvent extraction process and the thermal cracking (or catalytic cracking or hydrocracking) process together.

In this regard, the solvent extraction process is preferably the solvent deasphalting process.

The present invention may also be designed so that the residue separated in the separation step is upgraded through the solvent extraction or catalytic cracking process in the thermal cracking or catalytic cracking unit and then the hydrocracking process in the hydrocracking unit. Likewise, part of the liquid phase of hydrocarbon oil produced from the thermal cracking or catalytic cracking process of the residue is added to the hydrocarbon oil feedstock in the mixing step, whereas the rest part of the liquid phase of hydrocarbon oil is additionally subjected to the hydrocracking process and added to the hydrocarbon oil feedstock.

On the other hand, the present invention may also be designed, as shown in FIG. 3B, so that part of the liquid phase of hydrocarbon oil produced through the solvent extraction unit 4*a* or the thermal cracking or catalytic cracking unit 4*b* is subjected to the hydrocracking process in the hydrocracking unit 4*c* again.

In this regard, part of the liquid phase of hydrocarbon oil produced through the solvent extraction process is added to the hydrocarbon oil feedstock in the mixing step, whereas the rest part of the liquid phase of hydrocarbon oil is additionally subjected to the thermal cracking or catalytic cracking process, and part of it is added to the hydrocarbon oil feedstock, the rest part of it being subjected to the hydrocracking process again and then added to the hydrocarbon oil feedstock.

Besides, the solvent extraction unit 4*a*, the thermal cracking (or catalytic cracking) unit 4*b*, and the hydrocracking unit 4*c* may not be connected in sequential order but arranged in parallel and connected to the separator 3 to perform the above-described procedures.

Example 1

Measurement of Dehydration Efficiency for Hydrocarbon Oil Feedstock Mixed with Liquid Phase of Hydrocarbon Oil In order to evaluate the performance of the present invention to treat heavy hydrocarbon oil, the following procedures are performed in the experiments to measure the dehydration efficiency for the hydrocarbon oil mixed with the liquid phase of hydrocarbon oil using the desalting process.

90 vol. % of hydrocarbon oil containing heavy hydrocarbon oil, light hydrocarbon oil and liquid phase of hydrocarbon oil, 10 vol. % of water, and 100 ppm of a demulsifier are mixed together in a blender for 10 minutes, and the resultant mixture is subjected to electrical desalting at 90° C. for 15 minutes with a batch type electrical desalter to yield an oil-rich phase/layer.

The water content of the oil-rich phase/layer thus obtained is measured using the Karl-Fisher method and the centrifugal separation method to evaluate the dehydration efficiency. The lower water content means the higher efficiency of the dehydration process.

In the experiments, the mixing proportion of the heavy oil, light oil and liquid phase of hydrocarbon oil contained in the hydrocarbon oil and the method of producing the liquid phase of hydrocarbon oil are varied as follows. The experimental results are presented as shown in the tables 1 and 2.

Experiment Example 1

Hydrocarbon oil containing light hydrocarbon oil (32.8° API) and heavy hydrocarbon oil (18.2° API) is mixed with liquid phase of hydrocarbon oil (30.2° API) produced from the residue through the delayed coking process that is a thermal cracking process.

TABLE 1

| | Mixing proportion (%) | | | |
|---|---|---|---|---|
| | Light hydrocarbon oil | Heavy hydrocarbon oil | liquid phase of hydrocarbon oil | Water content (%) |
| Experiment 1-1 | 85 | 15 | 0 | 0.10 |
| Experiment 1-2 | 75 | 25 | 0 | 0.25 |
| Experiment 1-3 | 75 | 15 | 10 | 0.12 |
| Experiment 1-4 | 70 | 15 | 15 | 0.13 |

Experiment Example 2

Hydrocarbon oil containing light hydrocarbon oil (32.8° API) and heavy hydrocarbon oil (18.2° API) is mixed with liquid phase of hydrocarbon oil (28.1° API) produced from the residue through the catalytic cracking process.

TABLE 2

| | Mixing proportion (%) | | | |
|---|---|---|---|---|
| | Light hydrocarbon oil | Heavy hydrocarbon oil | liquid phase of hydrocarbon oil | Water content (%) |
| Experiment 2-1 | 85 | 15 | 0 | 0.10 |
| Experiment 2-2 | 75 | 25 | 0 | 0.25 |
| Experiment 2-3 | 75 | 12.5 | 12.5 | 0.11 |
| Experiment 2-4 | 70 | 12.5 | 17.5 | 0.15 |

It can be seen from the results of Experiment 1 that performing the desalting process as a dehydration method of adding a liquid phase of hydrocarbon oil to the hydrocarbon oil containing heavy hydrocarbon oil can reduce the mixing proportion of the light hydrocarbon oil by 15%. Further, the difference of the whole water content is no more than about 0.03% even when the content of the light hydrocarbon oil is reduced by 5%.

As can be seen from the results of Experiment 2, the difference of the whole water content is no more than about 0.04% when the mixing proportion of the liquid phase of hydrocarbon oil is raised to reduce the content of the light hydrocarbon oil by 5%.

The above-described experiments reveal that the treatment of heavy hydrocarbon oil with a liquid phase of hydrocarbon oil produced from the oil-upgrading process can not only reduce the content of the relatively expensive light hydrocarbon oil, but also increase the content of the relatively inexpensive heavy hydrocarbon oil, ending up with the higher throughput of the heavy hydrocarbon oil.

In accordance with one embodiment of the present invention, hydrocarbon oil containing heavy hydrocarbon oil can be processed to be "lighter" using a liquid phase of hydrocarbon oil, increasing the throughput of the hydrocarbon oil in the dehydration process of oil-water separation, desalting, etc. in the oil production or refining process, so it is possible to decrease the content of the relatively expensive light hydrocarbon oil and increase the content of the relatively cheap heavy hydrocarbon oil, only to curtail the production cost and enhance the oil refinery profit.

In addition, the residue formed in the separation process can be reused in the oil-upgrading process to produce the liquid phase of hydrocarbon oil, increasing the efficiency of the process. Further, it has only to add the process of injecting the liquid phase of hydrocarbon oil to the existing oil production or refinery facilities in order to implement the method of treating heavy hydrocarbon oil according to the present invention, thereby reducing the facility expense.

The present invention is not limited to the described exemplary embodiments and descriptions. Instead, it would be appreciated by those skilled in the art that changes may be made to these exemplary embodiments without departing from the principles of the present invention, the scope of which is defined by the claims.

What is claimed is:

1. A method for treating heavy hydrocarbon oil using a liquid phase of hydrocarbon oil to increase throughput of heavy hydrocarbon oil in an oil production or refining process including a dehydration process, the method comprising:

(a) a mixing step of adding and mixing a liquid phase of hydrocarbon oil to a hydrocarbon oil feedstock containing heavy hydrocarbon oil to produce a feedstock processed to be lighter;

(b) a dehydration step of removing water from the feedstock processed to be lighter;

(c) a separation step of separating the feedstock obtained from the dehydration step into gas, non-residual oil and residue; and (d) an oil-upgrading step of modifying the residue to produce a liquid phase of hydrocarbon oil, wherein the liquid phase of hydrocarbon oil produced in the oil-upgrading step is added to the hydrocarbon oil feedstock of the mixing step.

2. The method as claimed in claim 1, wherein the dehydration step is performed by at least one process of separation, coalescence and desalting.

3. The method as claimed in claim 1, wherein the oil-upgrading step is performed to modify the residue by at least one process of thermal cracking, hydrocracking, solvent extraction, and catalytic cracking.

4. The method as claimed in claim 1, wherein the oil-upgrading step is performed to modify the residue by solvent extraction and then an additional process of thermal cracking, catalytic cracking or hydrocracking, and wherein a part of the liquid phase of hydrocarbon oil produced from the solvent extraction of the residue is added to the hydrocarbon oil feedstock of the mixing step, and a rest part of the liquid phase of hydrocarbon oil is processed by the additional process of thermal cracking, catalytic cracking or hydrocracking and then added to the hydrocarbon oil feedstock of the mixing step.

5. The method as claimed in claim 1, wherein the oil-upgrading step is performed to modify the residue by thermal cracking or catalytic cracking and then an additional process of hydrocracking, and wherein a part of the liquid phase of hydrocarbon oil produced from the thermal cracking or catalytic cracking is added to the hydrocarbon oil feedstock of the mixing step, and a rest part of the liquid phase of hydrocarbon oil is processed by the additional process of hydrocracking and then added to the hydrocarbon oil feedstock of the mixing step.

6. The method as claimed in claim 1, wherein the hydrocarbon oil feedstock has an API gravity of 10 to 30°.

7. The method as claimed in claim 1, wherein the liquid phase of hydrocarbon oil has an API gravity of 15° or greater.

8. An apparatus for treating heavy hydrocarbon oil using a liquid phase of hydrocarbon oil to increase throughput of heavy hydrocarbon oil in an oil production or refinery facility including a dehydration process, the apparatus comprising:

a mixer for adding and mixing a liquid phase of hydrocarbon oil to a hydrocarbon oil feedstock containing heavy hydrocarbon oil to produce a feedstock processed to be lighter;

a dehydrator for removing water from the feedstock processed to be lighter;

a separator for separating the feedstock obtained from the dehydrator into gas, non-residual oil and residue; and an oil-upgrading unit for modifying the residue to produce a liquid phase of hydrocarbon oil, wherein the liquid phase of hydrocarbon oil produced from the oil-upgrading unit is added into the mixer.

9. The apparatus as claimed in claim 8, wherein the dehydrator comprises at least one of a separator, a coalescer and a desalter.

10. The apparatus as claimed in claim 8, wherein the oil-upgrading unit comprises at least one of a thermal cracking unit, a hydrocracking unit, a solvent extraction unit, and a catalytic cracking unit.

11. The apparatus as claimed in claim 8, wherein the hydrocarbon oil feedstock has an API gravity of 10 to 30°.

12. The apparatus as claimed in claim 8, wherein the liquid phase of hydrocarbon oil has an API gravity of 15° or greater.

* * * * *